US005938142A

United States Patent [19]

Halperin

[11] Patent Number: 5,938,142

[45] Date of Patent: Aug. 17, 1999

[54] PAPER ROLL CONTROL DEVICE

[76] Inventor: Steven Halperin, 48 Fernwood La., Roslyn, N.Y. 11576

[21] Appl. No.: 09/148,600

[22] Filed: Sep. 4, 1998

[51] Int. Cl.[6] ..... B65H 16/06

[52] U.S. Cl. ..... 242/423.1; 242/598.5; 242/599.1; 242/599.4

[58] Field of Search ..... 242/423.1, 598, 242/598.5, 599, 599.1, 599.3, 599.4

[56] References Cited

U.S. PATENT DOCUMENTS

| | | | |
|---|---|---|---|
| 2,211,576 | 8/1940 | Moore | 242/598.5 |
| 2,699,903 | 1/1955 | Montgomery | 242/599.4 |
| 2,948,575 | 8/1960 | Kallman et al. | 312/34.8 |
| 3,850,379 | 11/1974 | Stern . | |
| 4,239,163 | 12/1980 | Christian . | |
| 4,248,391 | 2/1981 | Ness . | |
| 4,487,376 | 12/1984 | Compton . | |
| 4,522,348 | 6/1985 | Strout et al. | 242/599.3 |
| 4,919,350 | 4/1990 | Miller | 242/598.5 |
| 5,135,179 | 8/1992 | Morano . | |
| 5,215,274 | 6/1993 | Lin | 242/599 |
| 5,467,935 | 11/1995 | Moody | 242/599.1 |
| 5,755,397 | 5/1998 | Freese | 242/423.1 |
| 5,758,843 | 6/1998 | Ongaro | 242/599.1 |
| 5,762,285 | 6/1998 | Lin | 242/597.5 |

*Primary Examiner*—John P. Darling
*Attorney, Agent, or Firm*—Collard & Roe, P.C.

[57] ABSTRACT

A sheet material roll control device that comprises a series of protrusions that periodically intersect with each other while the sheet material roll rotates. One set of protrusions are located on a base while another set of protrusions are located on a roll plate. The roll plate is designed to fit on the end of a spindle that sits inside the roll core. In addition, attached to the roll plate and surrounding the spindle is an insert that rests flush inside the roll core. This insert fills the gap between the roll core and the outer shell of the spindle. With this insert, when the roll rotates, the spindle rotates with the roll, causing the roll plate to turn and periodically intersect protrusions located on the base, causing the rolling rate of the roll to slow down.

10 Claims, 5 Drawing Sheets

PAPER ROLL CONTROL DEVICE

BACKGROUND OF THE INVENTION

1. Field of the Invention

The invention relates to improvements in a roll control device that contains a series of protrusions designed to control the flow of paper off a roll. The protrusions contact each other as the roll is spinning causing the role to periodically pause in its spinning motion.

2. Description of the Prior Art

Roll control devices are known in the prior art. For example, U.S. Pat. No. 4,487,376 to Compton discloses a support for a conventional roll of perforated paper that contains an operable breaking device for impeding the rolling of towels when one towel is being torn off the roll.

In addition, U.S. Pat. No. 4,239,163 to Christian discloses a tissue holder that includes a brake member that is insertable to fit snugly into an open end of a cardboard tube on which a roll of tissue is wound before the roll of tissue is mounted on the roll holder. A spring loaded support spindle urges a base plate of the brake member against an arm of the roll holder, producing a frictional force which prevents free rotation of the tissue roll.

The present invention is an improvement over the prior art because it contains a series of protrusions designed to frictionally engage each other as a sheet material roll rotates about an axis. When these protrusions engage each other, there is a corresponding break or drop in the spinning rate of the roll.

SUMMARY OF THE INVENTION

One object of the invention is to provide a sheet material roll control device that controls the rolling rate for a roll of toilet paper-or paper towels. Another object of the invention is to provide a sheet material roll control device that informs visually impaired individuals how many sheets they roll off a roll. Another object of the invention is to provide a sheet material roll control device that prevents the backward rolling of the roll of toilet paper or paper towels. Another object of the invention is to provide roll control device for a material roll holder that is inexpensive to manufacture and ergonomically easy to install using only one hand.

To achieve these and other objects of the invention, there is provided a material roll control device comprising a stationary base having an inside face with a plurality of protrusions positioned thereon. In addition, the roll control device also contains a spindle for frictionally engaging the sheet material roll and rotating about an axis within the stationary base. Attached to the spindle is a material roll insert that contains a foam core designed to insert over the spindle. Covering the foam core is a hardened cylindrical shell. Attached to the outside of the cylindrical shell is a series of spacers that are in the form of elongated bars. These spacers allow the insert to fit snugly inside of a sheet material roll.

There is at least one plate attached to the insert for rotation therewith. This plate can have a roughened edge that is ⅜" to ½" thick. The plate also has a plurality of protrusions arranged on a face of the plate. Thus, when the material roll control device rotates, a plurality of protrusions on the plate frictionally engage the plurality of protrusions on the base. In this case, when these protrusions frictionally engage each other, they move the plate laterally along an axis to cause the sheet material roll to slow its rotational speed.

In another embodiment of the invention, the roll control device has a closed end for receiving a spindle. The roll plate has a closed end with a recessed region on its inside face designed to receive the rod portion of the spindle. In addition, the outside face of this roll plate contains a rod that inserts into the stationary base.

The protrusions can come in different forms and combinations. In a first embodiment of the invention, the protrusions on the base and on the plate have a triangular shaped cross-section. The triangular shaped cross-section is specifically designed to prevent the sheet material roll control device from rolling backward. If the device starts to roll backward, it runs flush against the flat back face of the triangular protrusions which thereby stop the backward roll of the device.

In addition, in a second embodiment of the invention the protrusions on both the base and the plate are hemispherical and have a circular cross-section. These hemispherical protrusions allow the device to roll both forward or backward. In a third embodiment of the invention, the protrusions on the base have a triangular cross-section while the protrusions on the plate have a circular cross-section. Finally, in a fourth embodiment of the invention, the protrusions on the base have a circular cross-section and the protrusions on the plate have a triangular cross-section.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1:
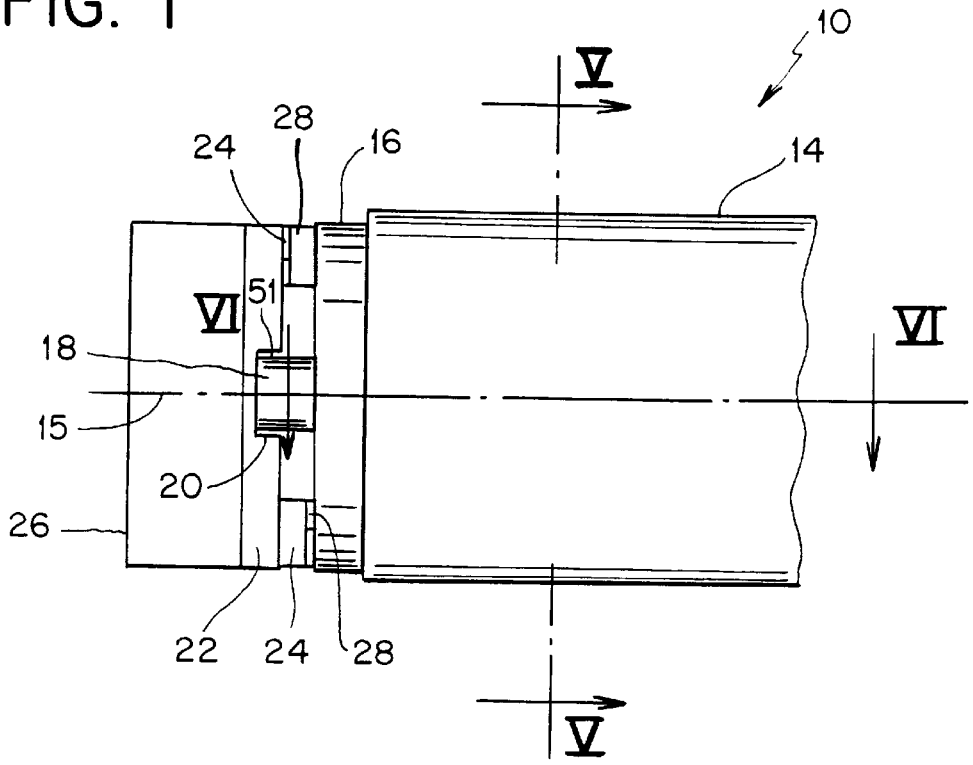
FIG. 1 is a side view of the material roll control device.

Referring to FIG. 1 shows a sheet material roll control device 10 that has a roll 14, roughened end piece or roll plate 16 and a rod 18. Rod 18 can extend from a spindle (see FIG. 5). Rod 18 fits into hole 20 on base plate 22. Base plate 22 is attached to an inside face on arm 26. Arm 26 extends from a stationary base (not shown). Disposed between roll plate 16 and base plate 22 are protrusions 24 and 28. Roll plate protrusions 28 are molded with roll plate 16 and engage base plate protrusions 24 attached to base plate 22.

Figure 2:
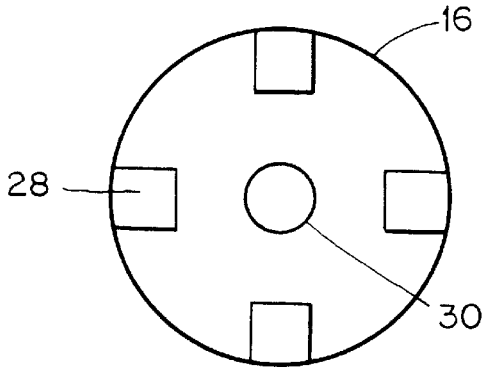
FIG. 2 is a front face view of the roll plate having protrusions.

FIG. 2 shows roll plate 16 having protrusions 28 and opening 30. Protrusions 28 have a triangular cross-section and are ramp-shaped (See FIG. 4). These protrusions 28 are spaced apart equidistant on roll plate 16. Opening 30 is designed to allow rod 18 to fit through.

Figure 3:
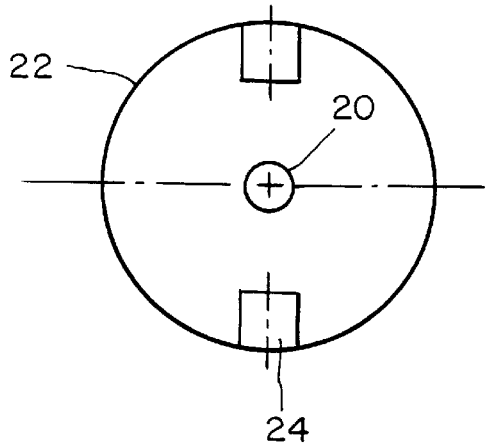
FIG. 3 is a front face view of the base plate having protrusions.
Figure 4:
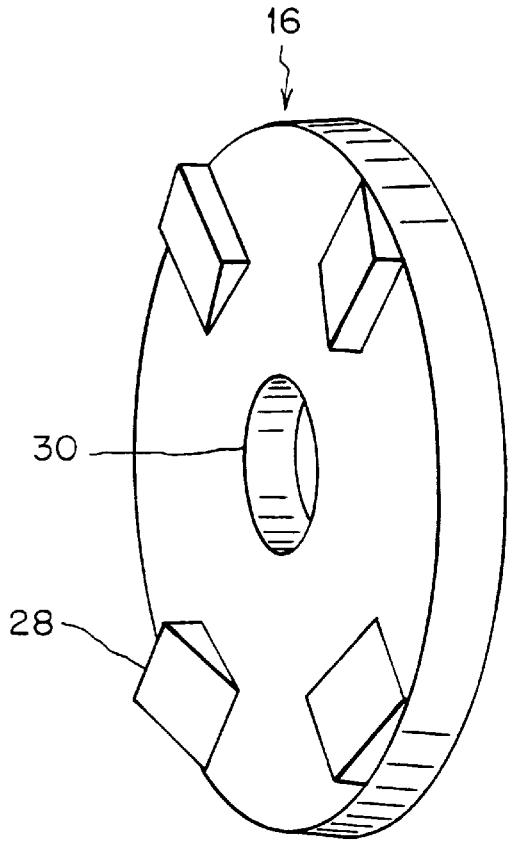
FIG. 4 is a perspective view of the roll plate.

FIG. 3 shows base plate 22 having protrusions 24 that have a triangular cross-section and are ramp-shaped (as shown in FIG. 4). Protrusions 24 are oriented so that a sheet material roll control device can rotate counterclockwise to dispense sheets. However, these protrusions can also be oriented in the opposite direction to allow the sheet material roll control device to rotate in the opposite direction. Base plate 22 has a hole 20 that acts as a recessed region on plate 22.

FIG. 4 shows a perspective view of roll plate 16 showing the triangular cross-sectional shape of protrusions 28.

Figure 5:
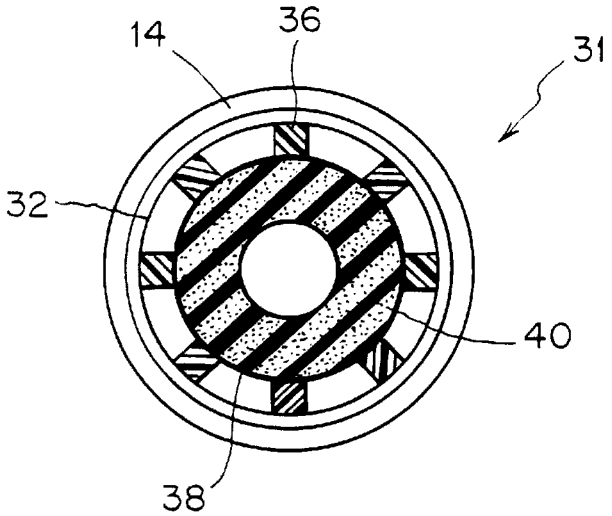
FIG. 5 is a cross-sectional end view of the insert for the sheet material roll control device taken along the line V—V.

FIG. 5 shows a cross-sectional view of sheet roll 14 having a core 32. Inside core 32 is insert 31 having spacers 36 fitting around shell 38. Spacers 36 are designed so that insert 31 fits snug inside roll core 32. In this way, when roll 14 rotates, insert 31 also turns with roll 14.

Figure 6:
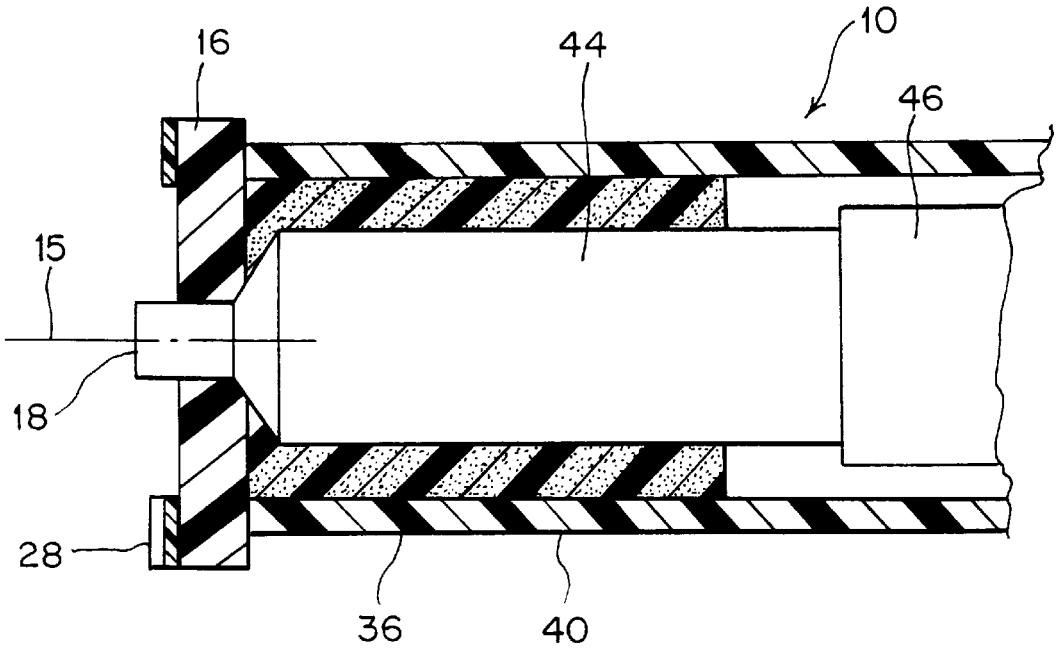
FIG. 6 is a cross-sectional view of the first embodiment of the sheet material roll control device taken along the line VI—VI of FIG. 1.

Spacers 36 attach to insert shell 38. Insert shell 38 is cylindrically-shaped and contains foam core 40. Foam core 40 is designed to fit snug around spindle piece 44 as shown in FIG. 6. In this way, when insert 31 rotates, it also rotates with spindle piece 44. Spindle piece 44 is spring loaded within spindle piece 46 so that spindle piece 44 can move inside spindle piece 46 to adjust the overall length of spindle 45. In addition, foam core 40 is designed to fit only around either spindle piece 44 or spindle piece 46 so that spindle piece 44 can adjust in length.

Sheet material roll control device 10 is designed so that roll plate 16 rotates around axis 15 wherein protrusions 28 periodically intersect protrusions 24 on base plate 22. In this case, when protrusions 28 intersect protrusions 24, insert 31 shifts laterally along axis 15. To allow this shift, spring loaded spindle piece 44 collapses into spindle piece 46.

Figure 7:
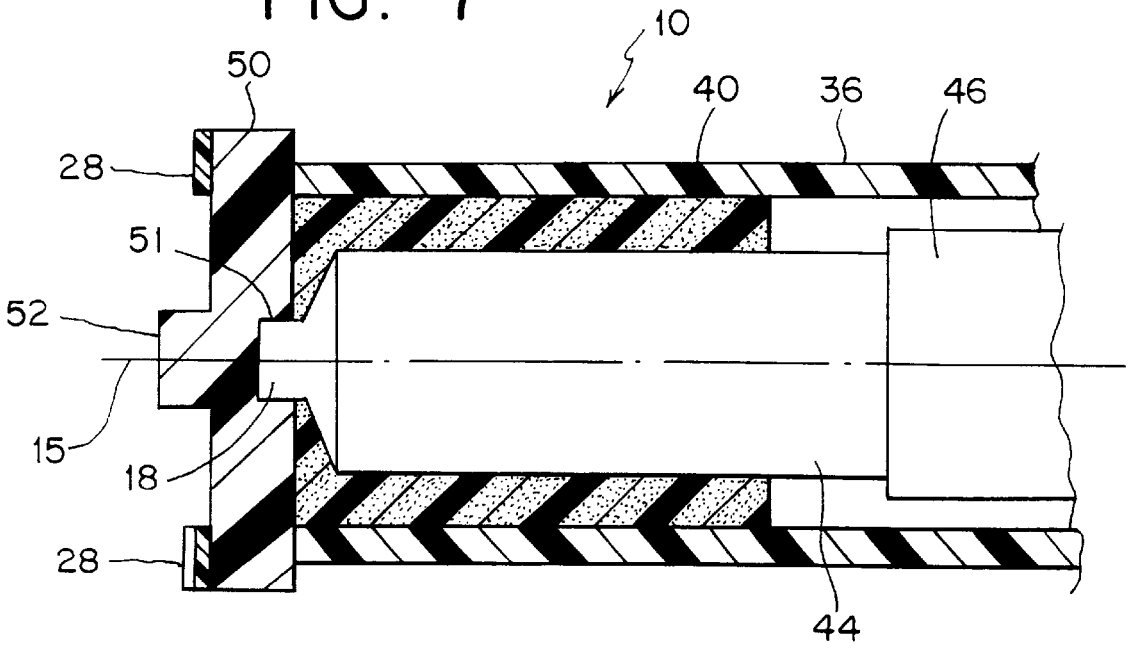
FIG. 7 is a cross-sectional view of the second embodiment of the sheet material roll control device.

FIG. 7 shows a second embodiment of roll control device 10 wherein spindle piece 44 fits inside roll plate 50. Roll plate 50 contains a cylindrically shaped insert hole 51 designed to receive rod 18 on spindle piece 44. In addition, extending out from the opposite end of roll plate 50 is cylindrical insert 52 and protrusions 28. Insert 52 fits into hole 20 on base plate 22. This second embodiment of roll control device 10 has a closed end that is designed to receive spindle 44. This design may be beneficial because rod 18 may not have sufficient length to extend into base plate 22.

Figure 8:
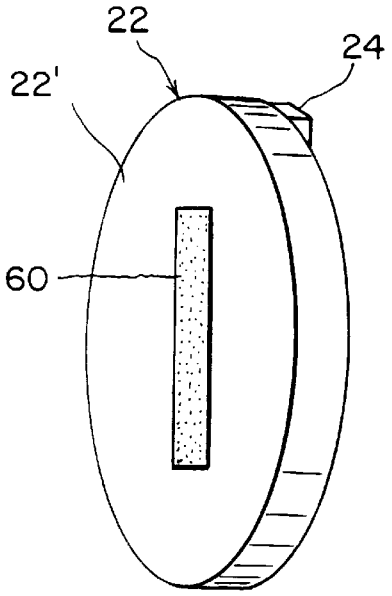
FIG. 8 is a perspective view of the baseplate having protrusions.

FIG. 8 shows a perspective view of base plate 22 having protrusions 24 and a two-sided adhesive 60. Two sided-adhesive 60 is designed to allow back face 22' of base plate 22 to fit onto stationary base 26.

Figure 9:
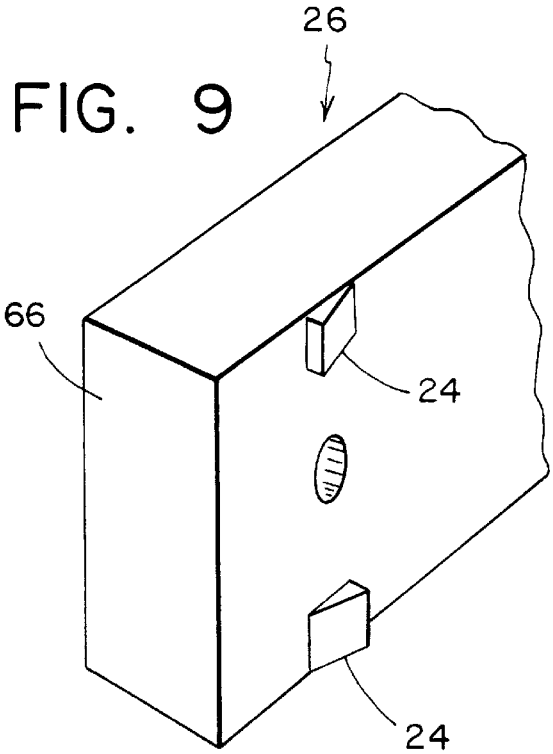
FIG. 9 is a perspective view of the stationary base having protrusions molded thereon.

FIG. 9 shows a second embodiment of stationary base 26 wherein protrusions 24 are molded onto arm 66. In this case hole 20 is also cut into arm 66 and designed to receive rod 18 from spindle 44 or insert 52 from roll plate 50.

Figure 10:
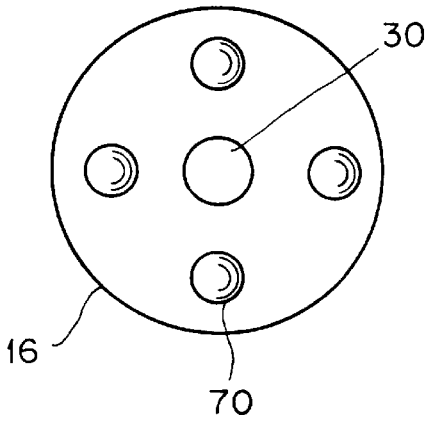
FIG. 10 shows a front end view of a second embodiment of the roll plate having rounded protrusions.

FIG. 10 shows a second embodiment for roll plate 16. In this case, roll plate 16 contains hemispherical protrusions 70 that have a semicircular cross-section. These protrusions allow the sheet material roll control device 10 to roll in either direction while still slowing the rolling rate. In addition, roll plate 16 contains hole 30 which is adapted to allow rod 18 or insert 52 to fit through.

Figure 11:
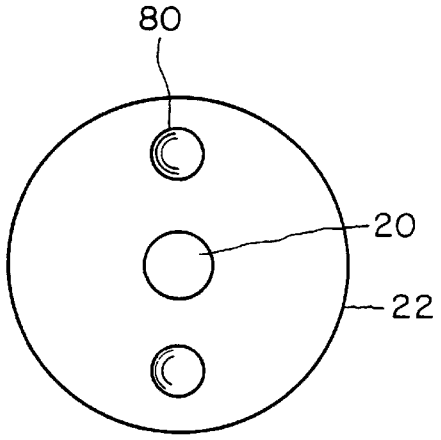
FIG. 11 shows a front end view of the base plate having rounded protrusions.

FIG. 11 is a second embodiment of end base plate 22 having hemispherical protrusions 80 having a semicircular cross-section. Because protrusions 80 are hemispherical, they allow roll control device to rotate in either a clockwise or counterclockwise direction.

Figure 12:
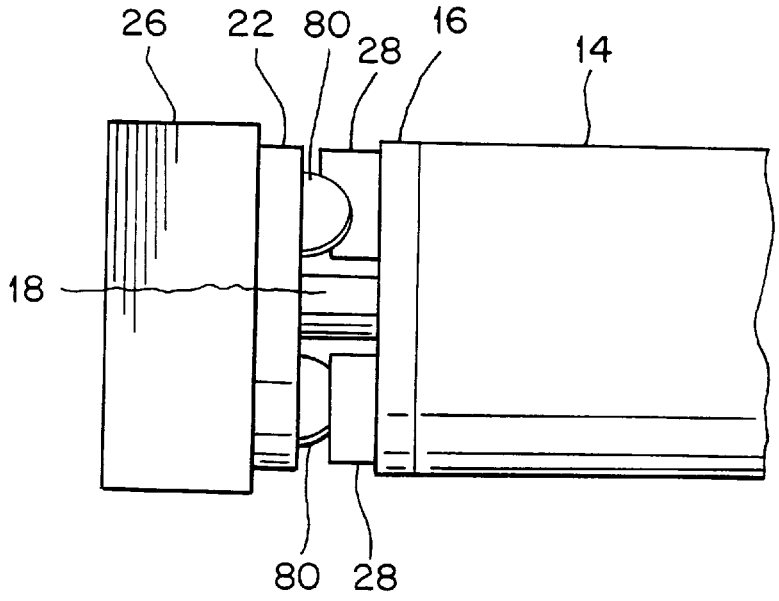
FIG. 12 shows one embodiment for the invention having semi-circular protrusions on the base plate and triangular shaped protrusions on the roll plate.

FIG. 12 shows one embodiment of the invention of the roll control device 10 wherein roll plate 16 contains protrusions 28 having a triangular shaped cross section while base plate 22 has hemispherical protrusions 80 having a semi-circular shaped cross section.

Figure 13:
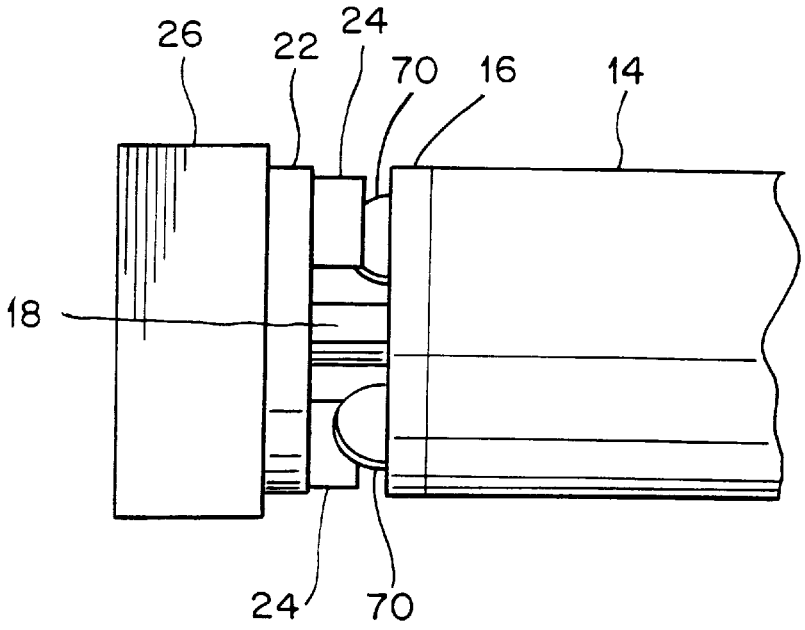
FIG. 13 shows another embodiment for the invention having triangular protrusions on the base plate and semicircular protrusions on the roll plate.

FIG. 13 shows another embodiment of roll control device 10 wherein roll plate 16 contains protrusions 70 that have a semi-circular cross section. In addition, base plate 22 has protrusions 24 having a triangular cross section.

In these embodiments, the sheet material roll control device controls the rolling rate of sheets from a roll. In addition, the protrusions can be spaced so that they intersect each other corresponding to perforations on each dispensed sheet. Furthermore, when these protrusions intersect each other, they can give off an audible click, giving a signal to the user that another sheet has been rolled off the roll. In this way, a person who is visually impaired would know how many sheets they pulled off the roll based upon the periodic resistance to rolling rate on the roll, or the number of clicks that they hear.

Accordingly, while only a single embodiment of the present invention has been shown and described, it is to be understood that many changes and modifications may be made thereunto without departing from the spirit and scope of the invention as defined in the appended claims.

What is claimed is:

1. A device for controlling the rolling of a material roll comprising:

a) a stationary base having an inside face with a recessed region;

b) a first plurality of protrusions positioned on said inside face of said stationary base;

c) a spindle for frictionally engaging said material roll and rotating about an axis within said recessed region on said stationary base;

d) at least one roll plate attached to said spindle for rotation therewith, said roll plate having a first surface attached to said spindle and a second surface facing said inside face of said stationary base; and e) a second plurality of protrusions arranged on said second face of said roll plate, wherein rotating said material roll causes said second plurality of protrusions to frictionally engage said first plurality of protrusions and causes the material roll to slow its rotational speed.

2. The device as in claim 1, wherein said plurality of protrusions on said base have a triangular shaped cross-section.

3. The device as in claim 1, wherein said plurality of protrusions on said roll plate have a triangular shaped cross-section.

4. The device as in claim 1, wherein said plurality of protrusions on said base have a semi-circular shaped cross-section.

5. The device as in claim 1, wherein said plurality of protrusions on said roll plate have a semicircular shaped cross-section.

6. The device as in claim 1, wherein said plurality of protrusions on said base comprise two protrusions spaced apart equidistant from each other.

7. The device as in claim 1, wherein said plurality of protrusions on said plate comprise four protrusions spaced apart equidistant from each other.

8. The device as in claim 1, wherein said spindle further comprises separator bars attached to said spindle, said separator bars providing spacing between said spindle and said material roll and allow said spindle to fit snug inside said material roll.

9. The device as in claim 1, further comprising a base plate attached to said base, said base plate for housing said first plurality of protrusions.

10. A device for controlling the rolling of a material roll comprising:

(a) a stationary base having an open inside face with a pivot hole in said inside face;

(b) a plurality of protrusions disposed on said inside face of said stationary base;

(c) a roll insert having two ends, said roll insert for fitting snugly inside a sheet material roll;

(d) a pivot bar attached to said roll insert and inserted into the pivot hole for rotation of the roll insert;

(e) a roll plate having an outer face facing towards said stationary base, said roll plate being keyed to said pivot bar for rotation therewith;

(f) a plurality of roll plate protrusion disposed on said outer face of said roll plate, said protrusions being arranged to contact said base protrusions as said sheet material roll rotates with said pivot bar, wherein rotating said material roll causes said second plurality of protrusions to frictionally engage said first plurality of protrusions and causes the material roll to slow its rotational speed.

* * * * *